US007120384B2

(12) United States Patent
Kenji et al.

(10) Patent No.: US 7,120,384 B2
(45) Date of Patent: Oct. 10, 2006

(54) PAPER PROCESSING UNIT FOR BINDING DEVICE

(75) Inventors: Umehara Kenji, Tokyo (JP); Yeon-Kawan Chung, Seoul (KR); Seong-Kyoon Noh, Seoul (KR)

(73) Assignees: KRDC Co., Ltd., Seoul (KR); Gradco Ltd., Tokyo (JP)

( * ) Notice: Subject to any disclaimer, the term of this patent is extended or adjusted under 35 U.S.C. 154(b) by 113 days.

(21) Appl. No.: 10/892,547

(22) Filed: Jul. 16, 2004

(65) Prior Publication Data

US 2006/0013629 A1 Jan. 19, 2006

(51) Int. Cl.
*G03G 15/00* (2006.01)
*B65H 33/04* (2006.01)
*B42C 9/00* (2006.01)

(52) U.S. Cl. ..... 399/408; 399/407; 270/58.09; 270/58.12; 270/58.19; 412/8; 412/9; 412/11

(58) Field of Classification Search ..... 399/408, 399/407; 270/58.12, 58.09, 58.19; 412/11, 412/8, 9

See application file for complete search history.

(56) References Cited

U.S. PATENT DOCUMENTS 5,320,336 A * 6/1994 Asami ..... 270/58.08
5,443,248 A * 8/1995 Hayashi et al. ..... 270/58.09
5,540,421 A * 7/1996 Ohta et al. ..... 270/58.19
5,569,011 A * 10/1996 Yamaguchi et al. ..... 412/9
5,918,872 A * 7/1999 Kato et al. ..... 270/58.12
5,931,624 A * 8/1999 Naruse ..... 412/8
5,992,839 A * 11/1999 Kosasa ..... 270/58.12
6,000,894 A * 12/1999 Suzuki et al. ..... 412/11
6,076,817 A * 6/2000 Kobayashi et al. ..... 270/58.09
6,671,491 B1 * 12/2003 Yamanaka et al. ..... 399/407
6,830,390 B1 * 12/2004 Hayashi ..... 400/76

* cited by examiner

*Primary Examiner*—Andrew H. Hirshfeld
*Assistant Examiner*—Marvin P. Crenshaw
(74) *Attorney, Agent, or Firm*—Greenblum & Bernstein, P.L.C.

(57) ABSTRACT

Disclosed is a paper processing unit for a binding device that can improve moving efficiency of a sheet of papers and prevent side binding error of the sheet of papers. The paper processing unit comprises a paper aligning unit including a tray stacking the sheet of papers, a rotational stopper provided at the end of the tray, stopping the sheet of papers stacked on the tray, and a paper clamp gripping the sheet of papers stacked on the tray and moving them to the paper finishing unit when stopping of the rotational stopper is released, and a binding carriage having a lifting unit structured to support the sheet of papers and adjust the angle of the sheet of papers depending on the binding position while the paper clamp moves the sheet of papers to the paper finishing unit and the binding process of the sheet of papers is performed, wherein the angle of the sheet of papers of which binding is finished is adjusted to move them to the position of the receiving stacker and an open tray is extended to the end of the tray to close and open.

8 Claims, 12 Drawing Sheets

PAPER PROCESSING UNIT FOR BINDING DEVICE

BACKGROUND OF THE INVENTION

1. Field of the Invention

The present invention relates to a binding device that binds papers ejected from a digital output device such as a printer and a copier by finishing them, and more particularly to a paper processing unit for the binding device.

2. Discussion of the Related Art

An example of a conventional binding device is disclosed in Japanese Patent Publication No. 8-301504. The conventional binding device will be described with reference to FIG. 1.

The conventional binding device 1 includes a paper processing unit 5, a paper carriage 2, a tape feeder 6, a tape heating unit 7, and a receiving stacker 8. The paper processing unit 5 is provided with a paper aligning unit 3 and a binding unit 4. The tape heating unit 7 serves as a paper finishing unit.

The paper carriage 2 includes an inlet 9*a* and an outlet 9*b*. A plurality of rollers 10 are provided between the inlet 9*a* and the outlet 9*b*. A flapper 13 is provided at the inlet 9*a* so that papers are flapped to a paper carriage path 14 when binding papers. The papers flapped to the paper carriage path 14 by the flapper 13 are conveyed to the paper aligning unit 3.

The paper aligning unit 3 includes a tray 16 receiving papers, an aligning paddle 18 aligning conveyed papers, a rotational stopper 19 temporarily putting the papers in a standby state after aligning them, and a paper clamp 15 gripping the papers aligned in the stop finger 19 and moving them to the tape heating unit 7.

The rotational stopper 19 and the paper clamp 15 are designed to grip the papers stacked on the tray 16 to move them to the tape heating unit 7. Once the papers are moved to the tape heating unit 7, the papers are subject to the binding process so that a tape fed from the tape feeder 6 is adhered to the rear end and side of the papers. The bound papers are then stacked on the receiving stacker 8 by the binding carriage 4.

SUMMARY OF THE INVENTION

The present invention is directed to a paper processing unit for a binding device that substantially obviates one or more of the problems due to limitations and disadvantages of the related art.

An object of the present invention is to provide a paper processing unit for a binding device that can reduce tape binding error by adjusting the whole support position of a sheet of papers depending on the tape binding position of the sheet of papers after the sheet of papers stacked on a tray is moved to a tape heating unit through a rotational stopper and a paper clamp.

Another object of the present invention is to provide a paper processing unit for a binding device that can improve moving efficiency of a sheet of papers and reduce moving error of the sheet of papers by improving a structure of a paper clamp and a rotational stopper.

Other object of the present invention is to provide a paper processing unit for a binding device that can have a small volume by flexibly adjusting the size of a tray to be used for a large sized paper.

Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

To achieve these and other advantages and in accordance with the purpose of the present invention, as embodied and broadly described, a binding device according to the present invention includes a lifting unit structured to support a sheet of papers, adjust the angle of the sheet of papers depending on the binding position while the sheet of papers is moved to a tape heating unit (paper finishing unit), and move the bound papers to the ejection position.

The paper aligning unit is structured in such a manner that a rotational stopper descends at the position where a paper clamp grips a predetermined sheet of papers after the sheet of papers is stacked the rotational stopper, the paper clamp moves the gripped papers to the tape heating unit, and then the rotational stopper returns to the original position to again stack moving papers thereon. Further, a folding type open tray that can extend the length of a tray is formed to be extended from the tray and is automatically opened during binding process.

In another aspect of the present invention, in a binding device comprising a paper processing unit that moves a sheet of papers from a paper carriage to a paper finishing unit (tape heating unit) and moves the sheet of papers finished by the paper finishing unit to a receiving stacker, the paper processing unit comprises a paper aligning unit including a tray stacking the sheet of papers, a rotational stopper provided at the end of the tray, stopping the sheet of papers stacked on the tray, and a paper clamp gripping the sheet of papers stacked on the tray and moving them to the paper finishing unit when stopping of the rotational stopper is released, and a binding carriage having a lifting unit structured to support the sheet of papers and adjust the angle of the sheet of papers depending on the binding position while the paper clamp moves the sheet of papers to the paper finishing unit and the binding process of the sheet of papers is performed, wherein the angle of the sheet of papers of which binding is finished is adjusted to move them to the position of the receiving stacker.

The binding carriage includes a conveyer so that the sheet of papers ejected from the lifting unit is moved to the receiving stacker through the conveyer.

The lifting unit includes an arc shaped angle adjusting gear engaged with a lifting unit driving gear and a paper support extended from the angle adjusting gear, the angle of the paper support being adjusted by rotating the angle adjusting gear along its support shaft when the driving gear is rotated.

The rotational stopper is linked to a crank fixed to the lower end of the tray and is rotated at a predetermined angle by driving the crank to move a protrusion toward upper and lower portions of the tray.

The paper clamp includes a clamp base and a clamp plate moving along a paper clamp sliding rail and a driving means closing and opening the clamp plate toward the clamp base.

The driving means of the clamp plate includes a clamp gear fixed to a rotary shaft of the clamp plate along with the clamp plate, a clamp motor rotating the clamp gear, and a spring fixed to the clamp plate to act tension on the clam base.

An open tray is provided at the outer end of the tray to externally close and open.

It is to be understood that both the foregoing general description and the following detailed description are exemplary and explanatory and are intended to provide further explanation of the invention as claimed.

BRIEF DESCRIPTION OF THE ATTACHED DRAWINGS

The invention will be described in detail with reference to the following drawings in which like reference numerals refer to like elements wherein.

DETAILED DESCRIPTION OF THE PREFERRED EMBODIMENTS

Figure 1:
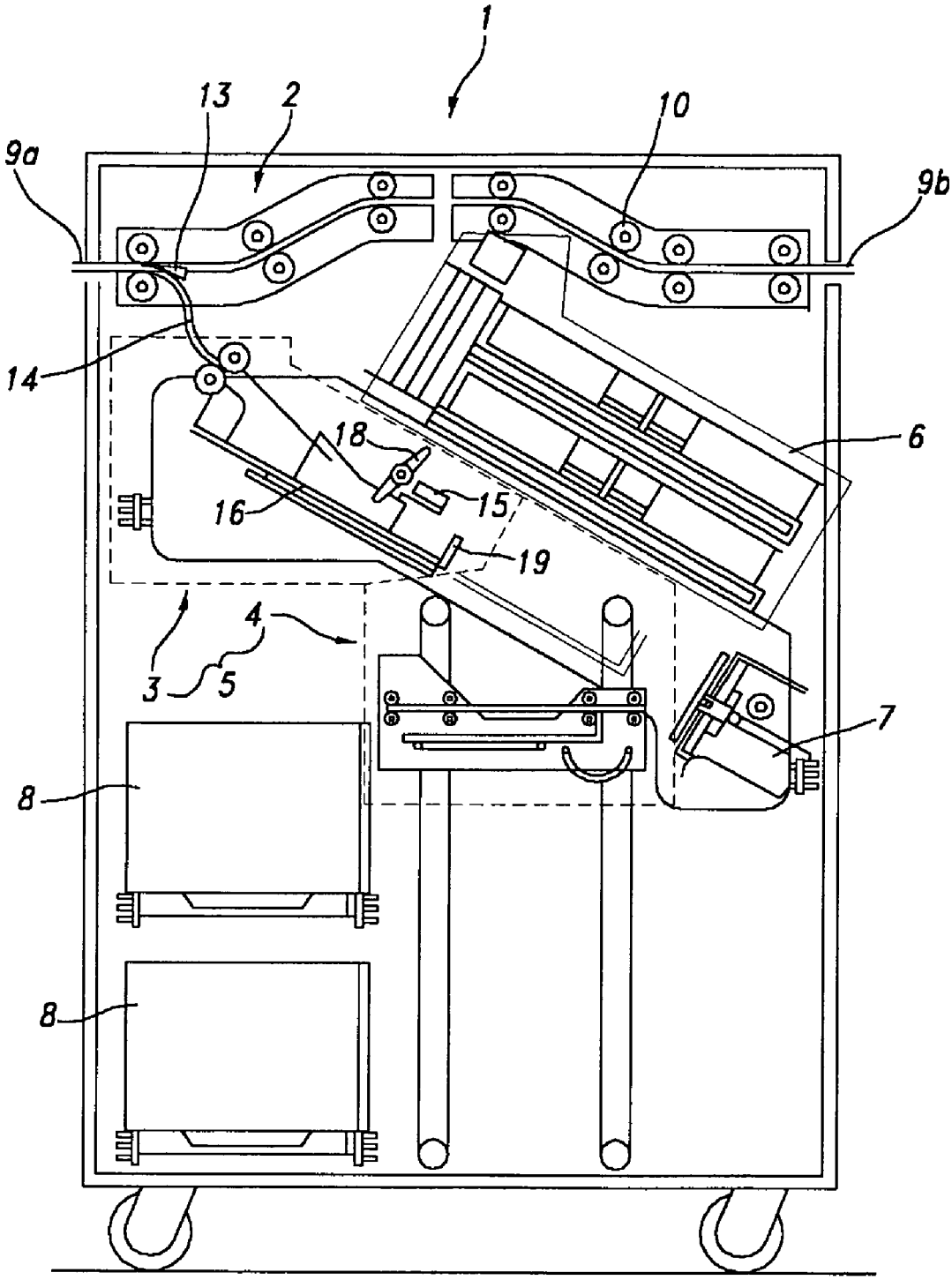
FIG. 1 illustrates a structure of a conventional binding device.

Reference will now be made in detail to the preferred embodiments of the present invention, examples of which are illustrated in the accompanying drawings.

A paper processing unit for a binding device according to the present invention will be described with reference to FIG. 2 to FIG. 12. The binding device according to the present invention has the same structure as that of the conventional binding device in the paper carriage 2, the tape heating unit 7, and the receiving stacker 8. The binding device of the present invention has an improved structure in the paper processing unit having a paper aligning unit and a binding carriage.

The paper processing unit 105 of the present invention includes a paper aligning unit 103 and a binding carriage 104. The paper aligning unit 103 includes a tray 116, an open tray 216, a paper aligning paddle 118, a rotational stopper 119, and a paper clamp 115. The binding carriage 104 includes a lifting unit 120 and a conveyer 121.

Particularly, the lifting unit 120 is structured to rotate a paper support 124 at a predetermined angle around a support shaft 152. The support 124 is rotated by an arc shaped angle adjusting gear 123 fixed thereto. The angle adjusting gear 123 is engaged with a driving gear 122, and the driving gear of the lifting unit is forwardly and reversely rotated by a lifting unit driving motor (not shown).

The lifting unit 120 moves a sheet of papers 150 stacked on the tray 116 to the tape heating unit 7 so that the paper support 124 supports the sheet of papers until the rear end 150*a* of the papers 150 is bound with a middle portion 151*a* of a tape 151 in a state that the paper support 124 is flush with the papers 150. Once the binding process is ended in a state that a paper support 154 provided in the tape heating unit is fixed to the end of the sheet of papers, a heating portion 153 of the tape heating unit 7 is moved in a direction of an arrow as shown in FIG. 5 so that sides 151*b* and 151*c* of the tape are respectively bound with sides 150*b* and 150*c* of the sheet of papers. In this process, the heating portion 153 of the tape heating unit pushes sides of the sheet of papers even though the support 154 of the tape heating unit supports the end of the sheet of papers. For this reason, the fixed position of the sheet of papers is deviated to lead the binding position of the tape and the sheet of papers to be deviated. To solve such a problem, as shown in FIG. 4 and FIG. 6, the position of the paper support 124 of the lifting unit is moved up and down depending on the tape binding position of the side of the sheet of papers, i.e., the movement position of the heating portion 153, so that the fixed position and the support position of the sheet of papers 150 can be adjusted to make the whole balance.

Figure 4:
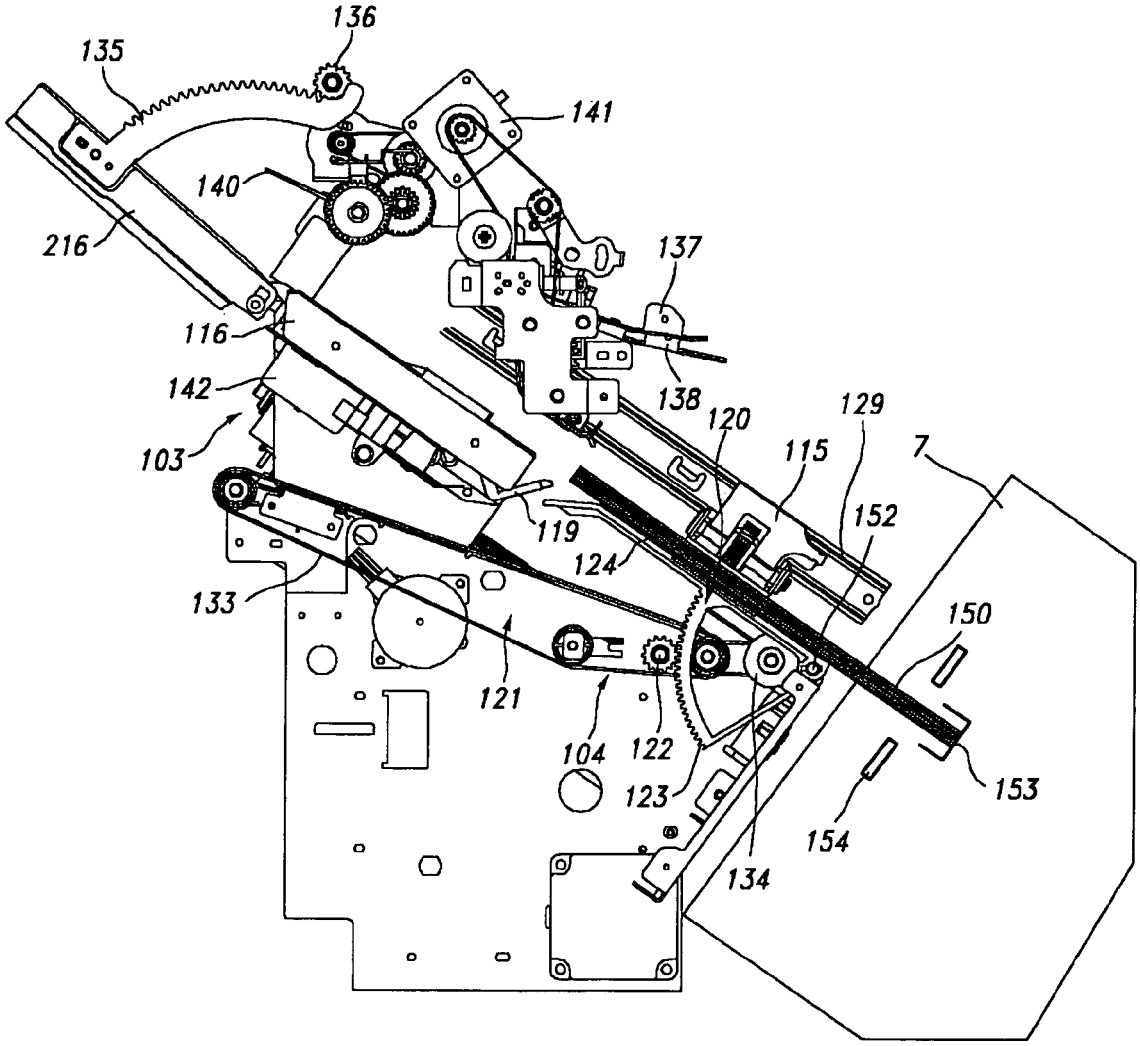
FIG. 4 illustrates the step of moving a sheet of papers stacked on a tray to a tape heating unit by means of a paper clamp.
Figure 5:
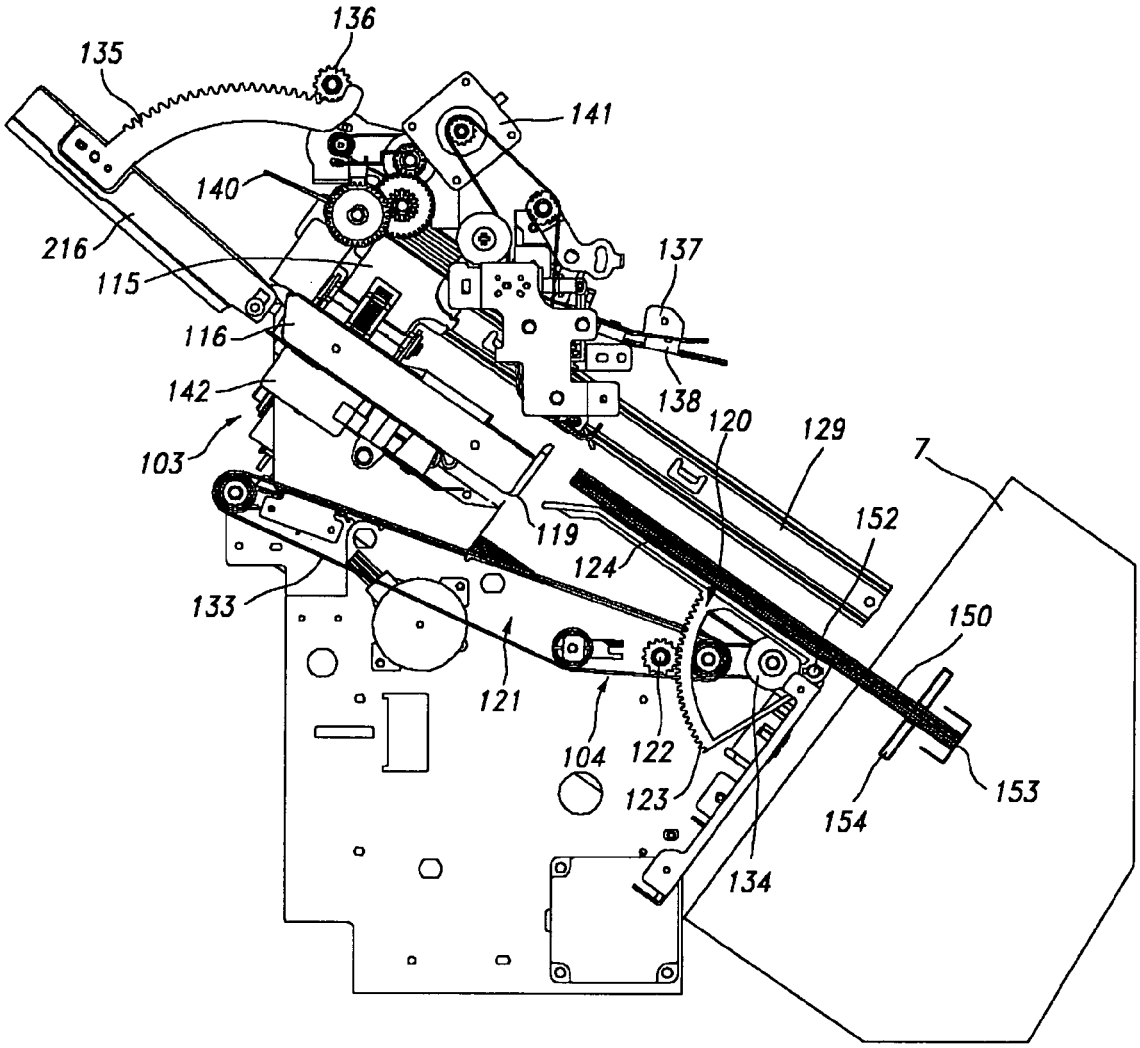
FIG. 5 illustrates a position structure of a lifting unit of a paper processing unit according to the present invention when the rear end of a sheet of papers moved to a tape heating unit is bound.

FIG. 4 illustrates a structure that moves a middle portion of the sheet of papers 150 stacked on the tray to the tape heating unit 7 with the paper clamp 115. When the papers are moved by the paper clamp, the rotational stopper 119 is automatically opened.

Once the papers 150 are moved to the tape heating unit by the paper clamp 115, the paper clamp 115 returns to the original position when the paper support 154 provided in the tape heating unit 7 supports the papers 150 as shown in FIG. 5.

Figure 6:
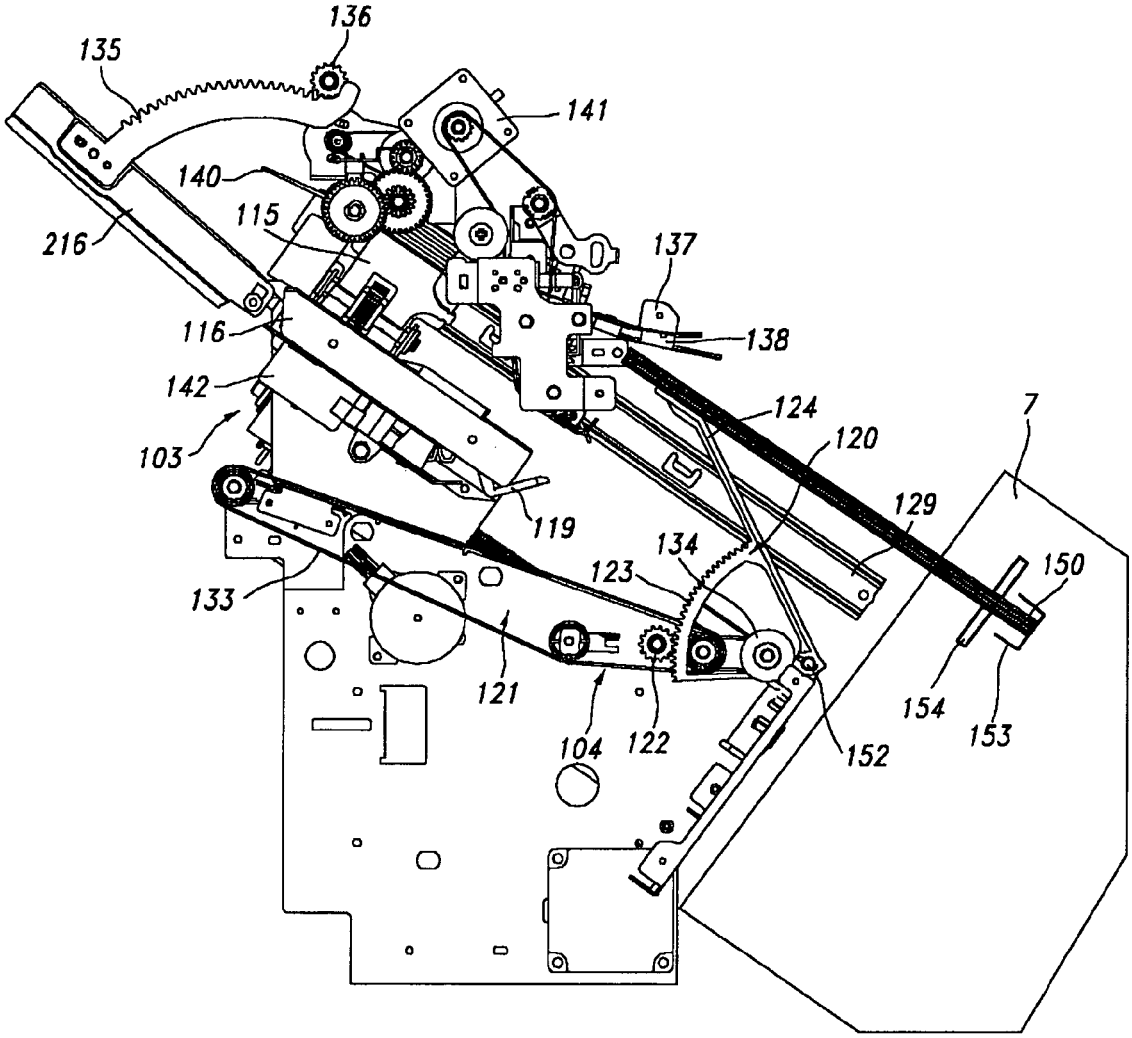
FIG. 6 illustrates a position structure of a lifting unit of a paper processing unit according to the present invention when the side of a sheet of papers moved to a tape heating unit is bound.

As shown in FIG. 5, in a state that the paper support 154 supports the papers 150, tape binding of the rear end of the papers is performed by moving the heating portion 153 of the tape heating unit as shown in FIG. 6. Particularly, since the angle of the paper support 124 of the lifting unit is varied depending on the moving position of the heating portion 153 of the tape heating unit, the support position of the papers is varied.

Figure 7:
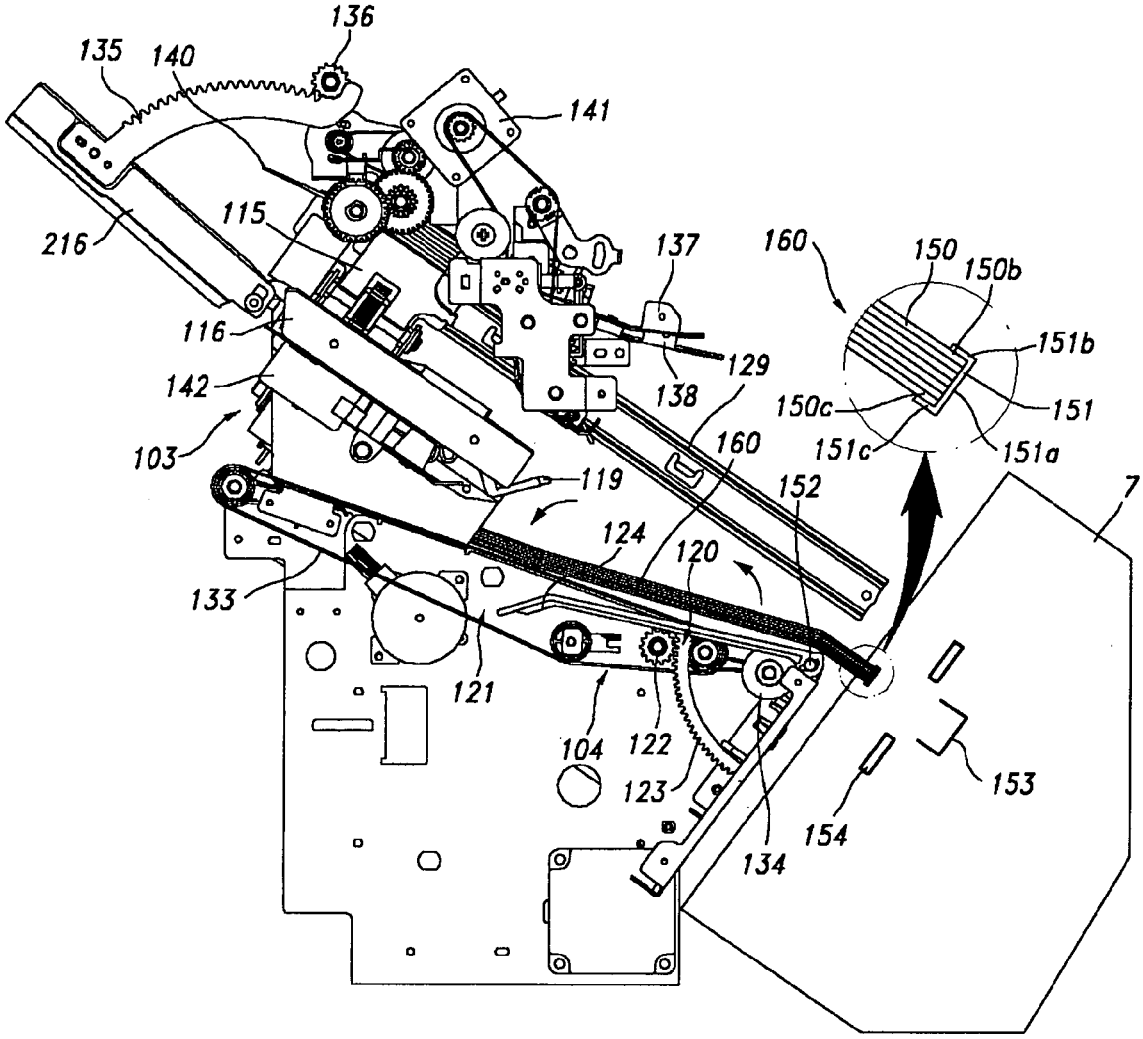
FIG. 7 illustrates a position structure of a lifting unit of a paper processing unit according to the present invention when a sheet of papers of which binding is finished is ejected to a receiving stacker.

Meanwhile, the binding papers 160 of which tape binding of the papers 150 is finished are put down on a belt 133 of a conveyer 121 as the driving gear 122 of the lifting unit is driven so that the paper support 124 descends toward the conveyer 121 as shown in FIG. 7.

Particularly, since the angle of the paper support 124 of the lifting unit is varied depending on the moving position of the heating portion 153 of the tape heating unit, the support position of the papers is varied.

Meanwhile, the binding papers 160 of which tape binding of the papers 150 is finished are put down on a conveyer belt 133 as the driving gear 122 of the lifting unit is driven so that the paper support 124 descends toward the conveyer 121 as shown in FIG. 7. Movement of the binding papers 160 is performed after the support 154 of the tape heating unit is detached from the binding papers.

The conveyer belt 133 is rotated by a conveyer driving gear (not shown), and the binding papers 160 laid on the conveyer belt 133 are moved to the receiving stacker 8 and stacked thereon.

The method of stacking the papers 150 on the tray 116 and moving them to the lifting unit 120 will be described in more detail.

Figure 2:
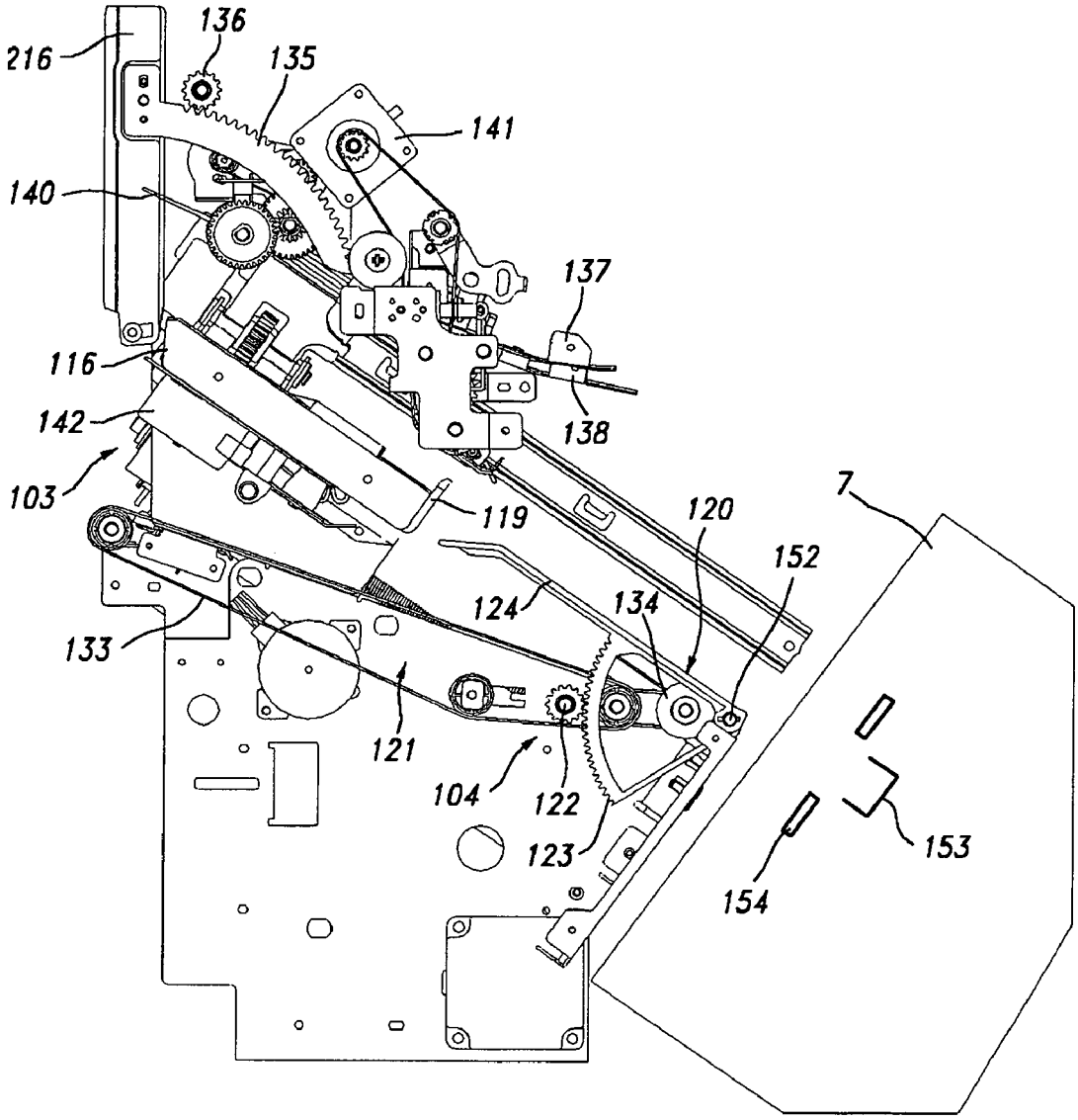
FIG. 2 illustrates the standby state of a paper processing unit for a binding device according to the present invention.

The paper processing unit of the present invention is in the standby state as shown in FIG. 2. The open tray 216 is opened if the paper processing unit is changed to a binding process mode. The open tray 216 is extended to the outer end of the tray 116 and is substantially flush with the upper surface of the tray 116 when it is opened. The open tray 216 is provided with an open tray gear 135 and an open tray driving gear 136 to automatically open the open tray 216 once the paper processing unit is changed to a binding process mode.

In the present invention, since the open tray 216 is externally exposed to be extended to the tray 116, the paper processing unit can have a small volume even though the large sized papers are bound. Particularly, the papers can be bound by manually inputting the papers to the binding device.

Figure 8:
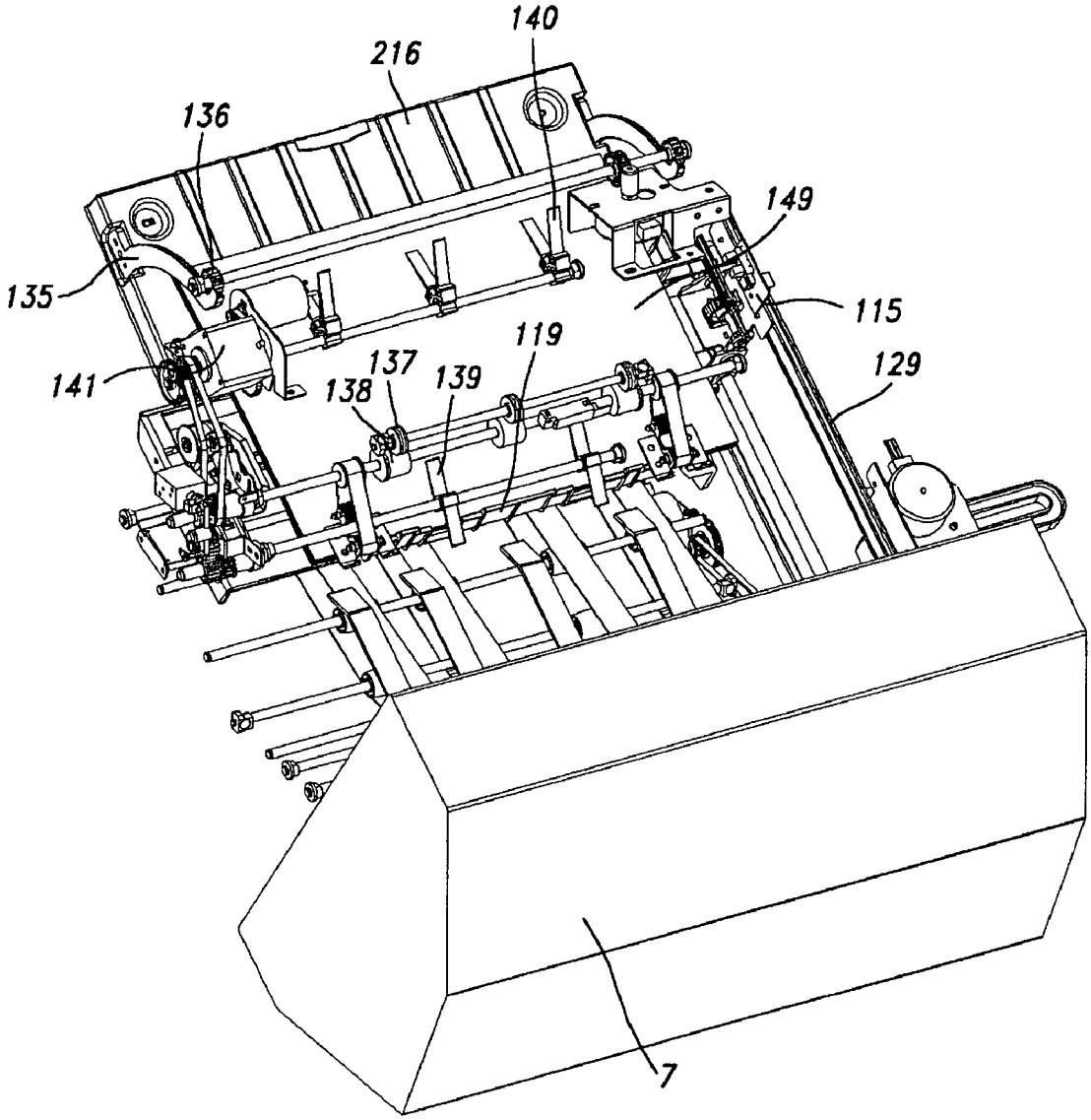
FIG. 8 is a perspective view illustrating a main part of a paper processing unit according to the present invention.
Figure 9:
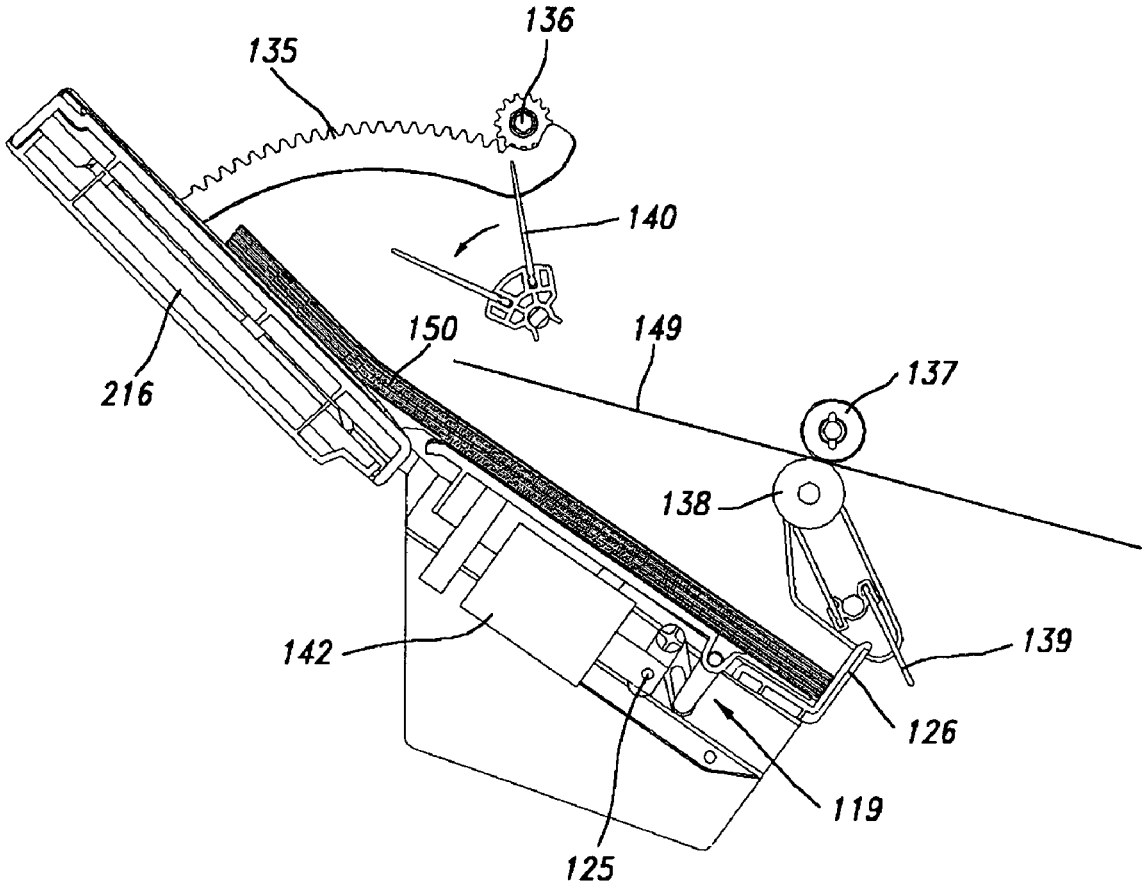
FIG. 9 illustrates the step of aligning papers of a paper processing unit according to the present invention.

Once the open tray 216 is opened, as will be aware of it from FIG. 8 and FIG. 9, paper 149 is moved between an idle roller 137 and a paper carriage roller 138. The paper 149 is aligned by a first paper aligning paddle 139 and a second paper aligning paddle 140 and then stacked on the open tray 216 and the tray 116 to form the sheet of papers 150.

The paper carriage roller 138 is rotated by a paper carriage roller driving motor 141. The motor 141 is also structured to drive the first and second paper aligning paddles 139 and 140 using gear and belt.

Figure 3:
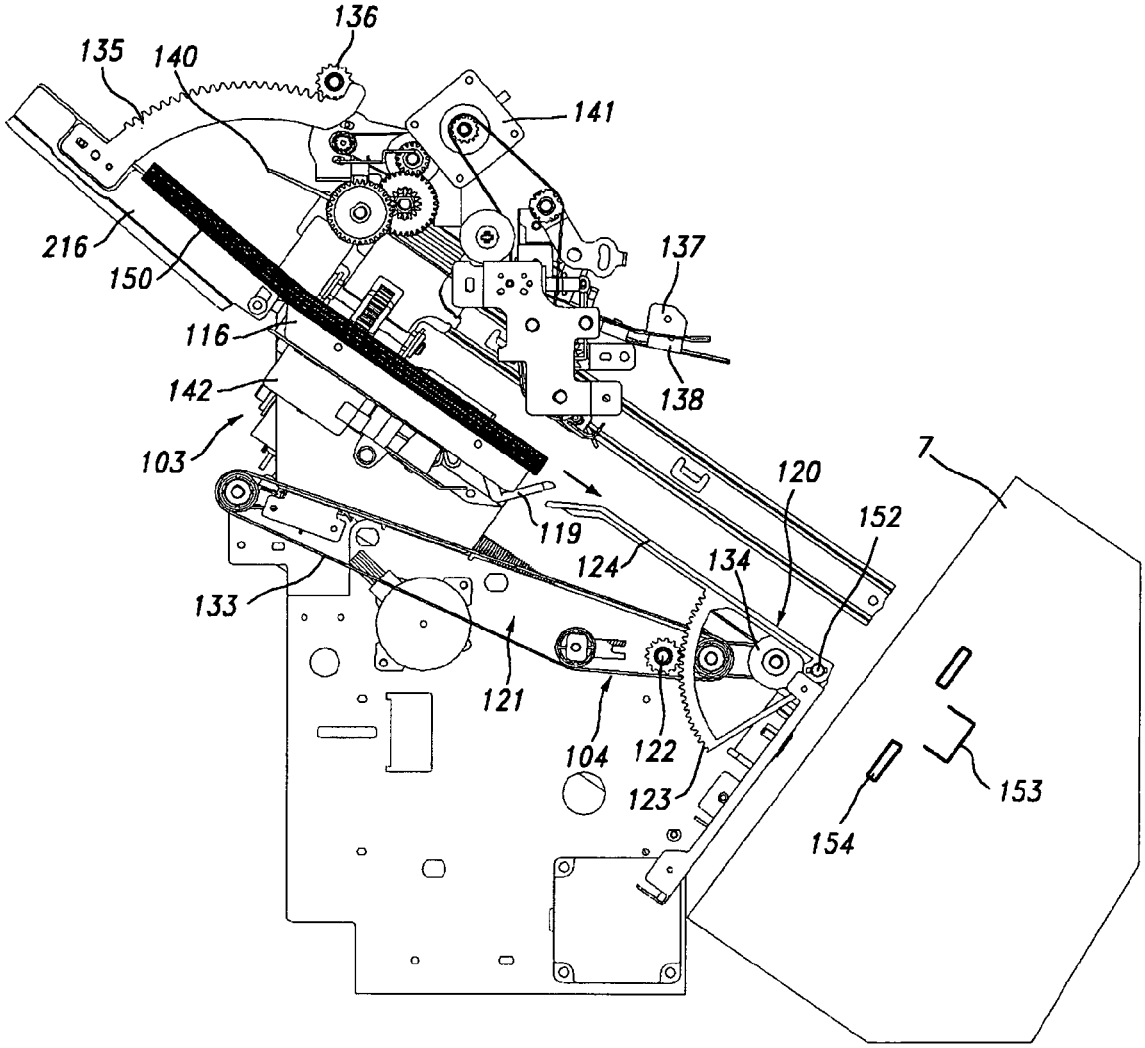
FIG. 3 illustrates the state before a sheet of papers stacked on a tray is moved to a lifting unit as a rotational stopper of a paper processing unit according to the present invention is opened.
Figure 10:
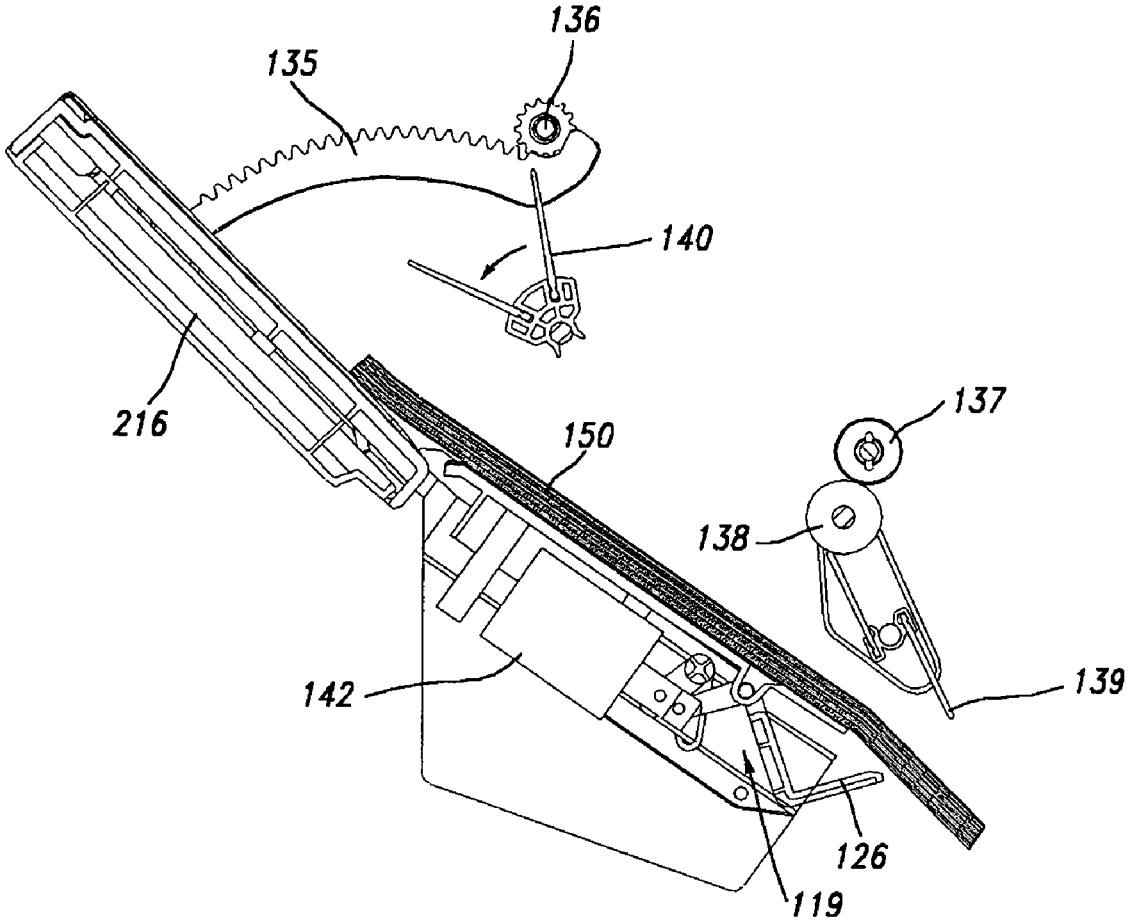
FIG. 10 illustrates an operational structure of a rotational stopper of a paper processing unit according to the present invention.

Once the side and section of the sheet of papers 150 stacked on the tray is gripped by the paper clamp 115, a protrusion 126 of the rotational stopper 119 that supports the sheet of papers at the lower end of the tray 116 descends as shown in FIG. 3 and FIG. 10.

Once the protrusion 126 of the rotational stopper 119 descends, the paper clamp 115 moves to the tape heating unit 7 along a sliding rail 129 in a state that it grips the sheet of papers. Once the end of the sheet of papers 150 is set to the tape heating unit, the grip state of the paper clamp 115 is released and the paper clamp 115 returns to the original position.

Particularly, the rotational stopper 119 serves to open and close the protrusion 126 at the fixed position of the end of the tray without moving along with the paper clamp 115, so that the sheet of papers can be stacked on the tray 116 as soon as it passes through the rotational stopper 119.

The rotational stopper 119 includes a crank shaft 125, a driving motor 142, and the protrusion linked to the crank shaft 125. The protrusion 126 can be moved to the upper and lower portions of the tray 116 by rotation of the crank shaft through the driving motor 142.

Figure 11:
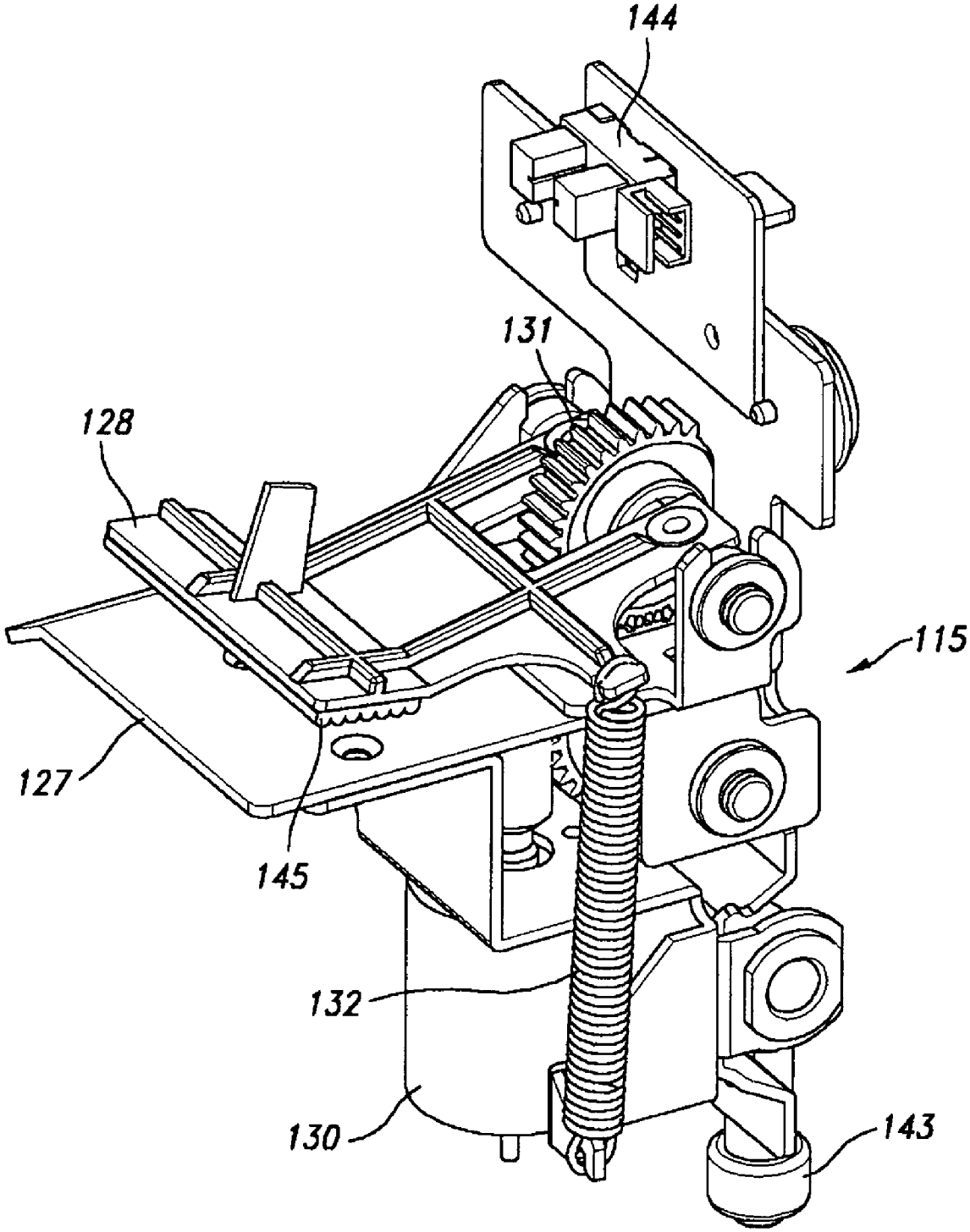
FIG. 11 illustrates the state that a paper clamp of a paper processing unit according to the present invention is closed.

Meanwhile, the structure of the paper clamp 115 that moves up and down along the sliding rail 129 will be described with reference to FIGS. 8, 11, and 12.

The paper clamp 115 includes a clamp base 127, a clamp plate 128, a clamp gear 131, a clamp motor 130, a spring 132, a roller 143, and a clamp sensor 144. The clamp motor 130 is fixed to the clamp base 127. The clamp plate 128 is opened by rotation of the clamp gear 131 driven by a signal of the clamp sensor 144 that senses the position of the clamp plate 128. Once the clamp plate 128 is moved to the clamp base 127 as shown in FIG. 11 to grip the sheet of papers stacked on the tray, tension of the spring 132 acts on the clamp base 127 to ensure the grip state of the sheet of papers.

Figure 12:
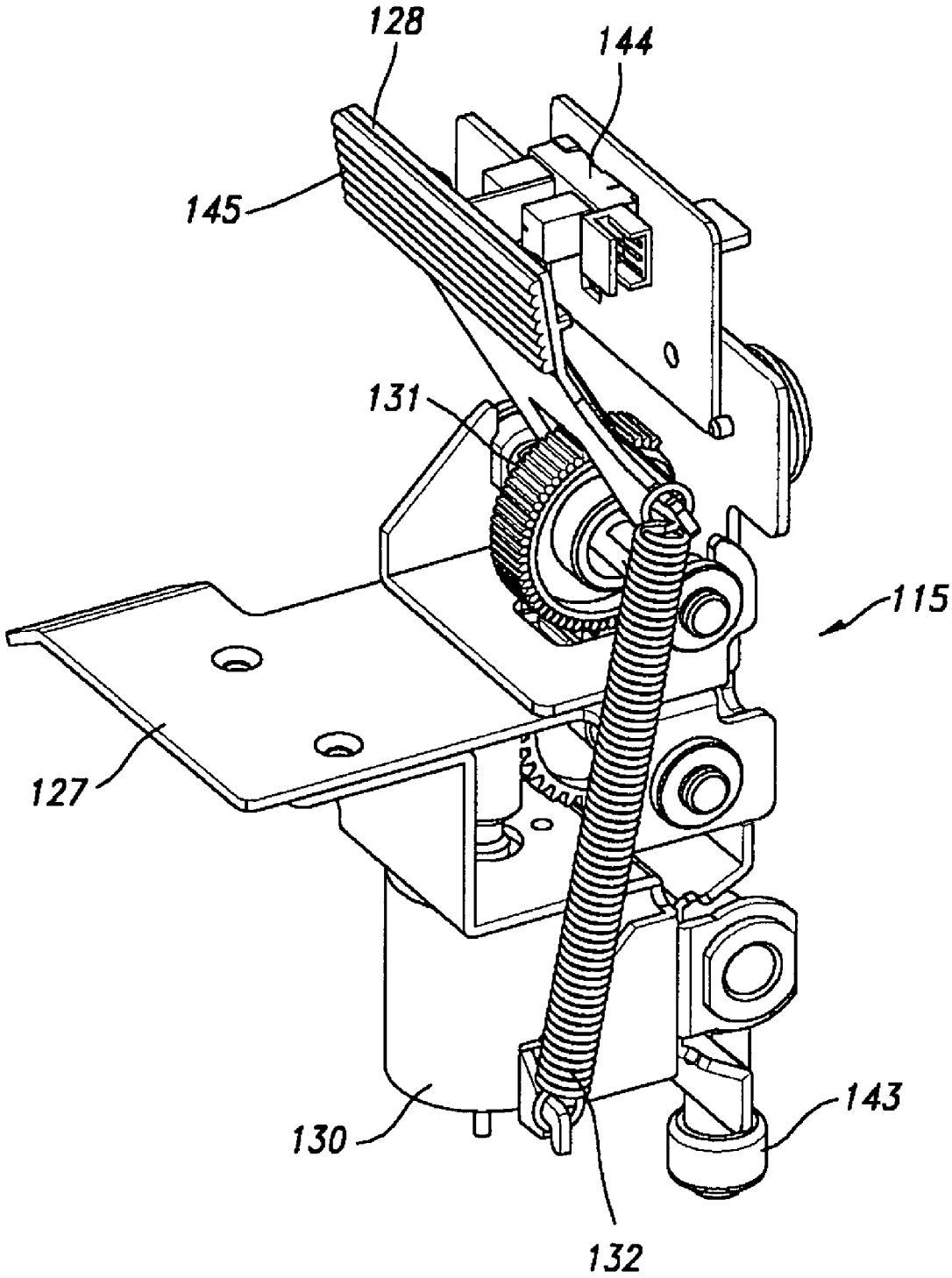
FIG. 12 illustrates the state that a paper clamp of a paper processing unit according to the present invention is opened.

Once the grip state of the sheet of papers is released from the paper clamp, the clamp plate 128 is opened as shown in FIG. 12. The clamp plate 128 may be provided with a rubber pad 145 having large friction to prevent sliding of the sheet of papers when the paper clamp grips the sheet of papers.

As aforementioned, the paper processing unit for a binding device according to the present invention have the following advantages.

In the paper processing unit of the binding device according to the present invention, the lifting unit 120 is structured to support the sheet of papers and adjust the angle of the sheet of papers depending on the binding position while the paper clamp 115 moves the sheet of papers to the paper finishing unit (tape heating unit 7) and the binding process of the sheet of papers is performed. The open tray 126 is extended to the end of the tray to open and close. Thus, moving efficiency of the sheet of papers can be improved and poor binding of the sheet of papers can be avoided. In addition, the paper processing unit can have a small volume to be used for the large sized papers, and the papers can be bound by manually inputting the papers to the binding device.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. In a binding device comprising a paper processing unit that moves a sheet of papers from a paper carriage to a paper finishing unit and moves the sheet of papers finished by the paper finishing unit to a receiving stacker, the paper processing unit comprising:

a paper aligning unit including a tray stacking the sheet of papers, a rotational stopper provided at the end of the tray, stopping the sheet of papers stacked on the tray, and a paper clamp gripping the sheet of papers stacked on the tray and moving them to the paper finishing unit when stopping of the rotational stopper is released; and a binding carriage having a lifting unit structured to support the sheet of papers and adjust the angle of the sheet of papers depending on the binding position while the paper clamp moves the sheet of papers to the paper finishing unit and the binding process of the sheet of papers is performed, wherein the angle of the sheet of papers of which binding is finished is adjusted to move them to the position of the receiving stacker.

2. The paper processing unit according to claim 1, wherein the binding carriage includes a conveyer so that the sheet of papers ejected from the lifting unit is moved to the receiving stacker through the conveyer.

3. The paper processing unit according to claim 1, wherein the lifting unit includes an arc shaped angle adjusting gear engaged with a lifting unit driving gear and a paper support extended from the angle adjusting gear, the angle of the paper support being adjusted by rotating the angle adjusting gear along its support shaft when the driving gear is rotated.

4. The paper processing unit according to claim 1, wherein the rotational stopper is linked to a crank fixed to the lower end of the tray and is rotated at a predetermined angle by driving the crank to move a protrusion toward upper and lower portions of the tray.

5. The paper processing unit according to claim 1, wherein the paper clamp includes a clamp base and a clamp plate moving along a paper clamp sliding rail and a driving means closing and opening the clamp plate toward the clamp base.

6. The paper processing unit according to claim 1, wherein the driving means of the clamp plate includes a clamp gear fixed to a rotary shaft of the clamp plate along with the clamp plate, a clamp motor rotating the clamp gear, and a spring fixed to the clamp plate to act tension on the clam base.

7. A paper processing unit comprising:

a tray stacking a sheet of papers moved from a paper carriage to move them to a paper finishing unit;

a stopper provided at the end of the tray, stopping the sheet of papers stacked on the tray;

a paper clamp gripping the sheet of papers stacked on the tray and moving them to the paper finishing unit when stopping of the stopper is released; and an opening provided at an outer end of the tray, wherein the opening is formed by an open tray at the outer end of the tray to close and open.

8. The paper processing unit according to claim 7, wherein the open tray is opened to support the rear end of the sheet of papers stacked on the tray, the opening is formed by opening the open tray, and the sheet of papers is manually stacked on the tray through the opening.

* * * * *